US008357291B2

(12) United States Patent
Sury et al.

(10) Patent No.: US 8,357,291 B2
(45) Date of Patent: Jan. 22, 2013

(54) UPGRADING BITUMEN IN A PARAFFINIC FROTH TREATMENT PROCESS

(75) Inventors: Ken N. Sury, Calgary (CA); Joseph L. Feimer, Brights Grove (CA); Clay R. Sutton, Redondo Beach, CA (US)

(73) Assignee: ExxonMobil Upstream Research Company, Houston, TX (US)

( * ) Notice: Subject to any disclaimer, the term of this patent is extended or adjusted under 35 U.S.C. 154(b) by 913 days.

(21) Appl. No.: 12/340,515

(22) Filed: Dec. 19, 2008

(65) Prior Publication Data

US 2009/0200209 A1 Aug. 13, 2009

Related U.S. Application Data

(60) Provisional application No. 61/065,371, filed on Feb. 11, 2008.

(51) Int. Cl.
*C10G 1/04* (2006.01)

(52) U.S. Cl. ..... 208/390; 208/391; 208/86; 208/87; 208/309

(58) Field of Classification Search ..... 208/309, 208/86, 87, 390, 391
See application file for complete search history.

(56) References Cited

U.S. PATENT DOCUMENTS

| | | | | |
|---|---|---|---|---|
| 3,656,330 | A * | 4/1972 | Brown et al. | 72/12.7 |
| 3,684,699 | A | 8/1972 | Vermeulen et al. | |
| 4,021,335 | A * | 5/1977 | Beaton | 208/309 |
| 4,676,889 | A | 6/1987 | Hsieh et al. | |
| 5,236,577 | A * | 8/1993 | Tipman et al. | 208/390 |
| 5,876,592 | A | 3/1999 | Tipman et al. | |
| 5,968,349 | A | 10/1999 | Duyvesteyn et al. | |
| 6,007,709 | A | 12/1999 | Duyvesteyn et al. | |
| 6,074,558 | A | 6/2000 | Duyvesteyn et al. | |
| 6,214,213 | B1 | 4/2001 | Tipman et al. | |
| 6,358,403 | B1 | 3/2002 | Brown et al. | |
| 6,358,404 | B1 | 3/2002 | Brown et al. | |
| 6,712,215 | B2 | 3/2004 | Scheybeler | |
| 6,800,116 | B2 | 10/2004 | Stevens et al. | |
| 6,945,096 | B1 | 9/2005 | Jones et al. | |
| 7,067,811 | B2 | 6/2006 | Long et al. | |
| 7,141,162 | B2 | 11/2006 | Garner et al. | |
| 7,556,715 | B2 | 7/2009 | Gaston et al. | |
| 2005/0150844 | A1 | 7/2005 | Hyndman et al. | |
| 2006/0113218 | A1 * | 6/2006 | Hart et al. | 208/391 |
| 2006/0138055 | A1 | 6/2006 | Garner et al. | |
| 2006/0196812 | A1 | 9/2006 | Beetge et al. | |
| 2006/0260980 | A1 | 11/2006 | Yeung | |
| 2007/0111903 | A1 | 5/2007 | Engel et al. | |

FOREIGN PATENT DOCUMENTS

| | | | |
|---|---|---|---|
| CA | 2075108 | C | 1/1997 |
| CA | 2200899 | A1 | 9/1998 |
| CA | 2149737 | C | 3/1999 |
| CA | 2 217 300 | C | 8/2002 |
| CA | 2232929 | C | 5/2004 |
| CA | 2425840 | A1 | 10/2004 |

(Continued)

*Primary Examiner* — Prem C Singh
*Assistant Examiner* — Michelle Stein
(74) *Attorney, Agent, or Firm* — ExxonMobil Upstream Research Company Law Department

(57) ABSTRACT

The invention relates to an improved bitumen recovery process. The process includes adding water to a bitumen-froth/solvent system containing asphaltenes and mineral solids. The addition of water in droplets increases the settling rate of asphaltenes and mineral solids to more effectively treat the bitumen for pipeline transport, further enhancement, refining, or any other application of reduced-solids bitumen.

19 Claims, 5 Drawing Sheets

FOREIGN PATENT DOCUMENTS

| | | | |
|---|---|---|---|
| CA | 2353109 | C | 12/2005 |
| CA | 2520943 | A1 | 4/2006 |
| CA | 2502329 | A1 | 9/2006 |
| CA | 2521248 | A1 | 3/2007 |
| CA | 2493677 | C | 5/2008 |
| CA | 2435113 | C | 6/2008 |

* cited by examiner

UPGRADING BITUMEN IN A PARAFFINIC FROTH TREATMENT PROCESS

CROSS-REFERENCE TO RELATED APPLICATION

This application claims the benefit of U.S. Provisional Patent Application 61/065,371 filed Feb. 11, 2008.

FIELD OF THE INVENTION

The present invention relates generally to producing hydrocarbons. More specifically, the invention relates to methods and systems for upgrading bitumen in a solvent based froth treatment process.

BACKGROUND OF THE INVENTION

The economic recovery and utilization of heavy hydrocarbons, including bitumen, is one of the world's toughest energy challenges. The demand for heavy crudes such as those extracted from oil sands has increased significantly in order to replace the dwindling reserves of conventional crude. These heavy hydrocarbons, however, are typically located in geographical regions far removed from existing refineries. Consequently, the heavy hydrocarbons are often transported via pipelines to the refineries. In order to transport the heavy crudes in pipelines they must meet pipeline quality specifications.

The extraction of bitumen from mined oil sands involves the liberation and separation of bitumen from the associated sands in a form that is suitable for further processing to produce a marketable product. Among several processes for bitumen extraction, the Clark Hot Water Extraction (CHWE) process represents an exemplary well-developed commercial recovery technique. In the CHWE process, mined oil sands are mixed with hot water to create slurry suitable for extraction as bitumen froth.

The addition of paraffinic solvent to bitumen froth and the resulting benefits are described in Canadian Patent Nos. 2,149,737 and 2,217,300. According to Canadian Patent No. 2,149,737, the contaminant settling rate and extent of removal of contaminants present in the bitumen froth generally increases as (i) the carbon number or molecular weight of the paraffinic solvent decreases, (ii) the solvent to froth ratio increases, and (iii) the amount of aromatic and napthene impurities in the paraffinic solvent decreases. Further, a temperature above about 30 degrees Celsius (° C.) during settling is preferred.

In many instances, it may be advantageous to observe the particle size distribution (PSD) in a particular bitumen-froth mixture. This may be done to ensure that the resulting heavy hydrocarbon product meets pipeline specifications and other requirements and lead to adjustments in the recovery process. Various techniques such as optical, laser diffraction, electrical counting, and ultrasonic techniques have been used to determine PSD.

One reason for processing the heavy hydrocarbon product in such a process is to eliminate enough of the solids to meet pipeline transport specifications and the specifications of the refining equipment. For example, the sediment specification of the bitumen product as measured by the filterable solids test (ASTM-D4807) may be used to determine if the product is acceptable. As such, a higher settling rate of solid particles including mineral solids and asphaltenes from the froth-treated bitumen is desirable.

Methods to improve the settling rate of the minerals can significantly impact the efficiency of heavy hydrocarbon (e.g. bitumen) recovery processes. There exists a need in the art for a low cost method to produce bitumen which meets various sediment specifications.

SUMMARY OF THE INVENTION

In one aspect of the invention, a method of recovering hydrocarbons is provided. The method includes providing a bitumen froth emulsion containing asphaltenes and mineral solids; adding a solvent to the bitumen froth emulsion to induce a rate of settling of at least a portion of the asphaltenes and mineral solids from the bitumen froth emulsion and generate a solvent bitumen-froth mixture; and adding water droplets to the solvent bitumen-froth mixture to increase the rate of settling of the at least a portion of the asphaltenes and mineral solids. In one aspect, the solvent may be a paraffinic solvent.

In another aspect of the invention, a system for recovering hydrocarbons is provided. The system includes a bitumen recovery plant configured to treat a froth-treated bitumen. The plant includes a froth separation unit having a bitumen froth inlet and a diluted bitumen outlet; and a water droplet production unit configured to add water droplets to the froth-treated bitumen.

BRIEF DESCRIPTION OF THE DRAWINGS

The foregoing and other advantages of the present invention may become apparent upon reviewing the following detailed description and drawings of non-limiting examples of embodiments in which.

DETAILED DESCRIPTION

Figure 1:
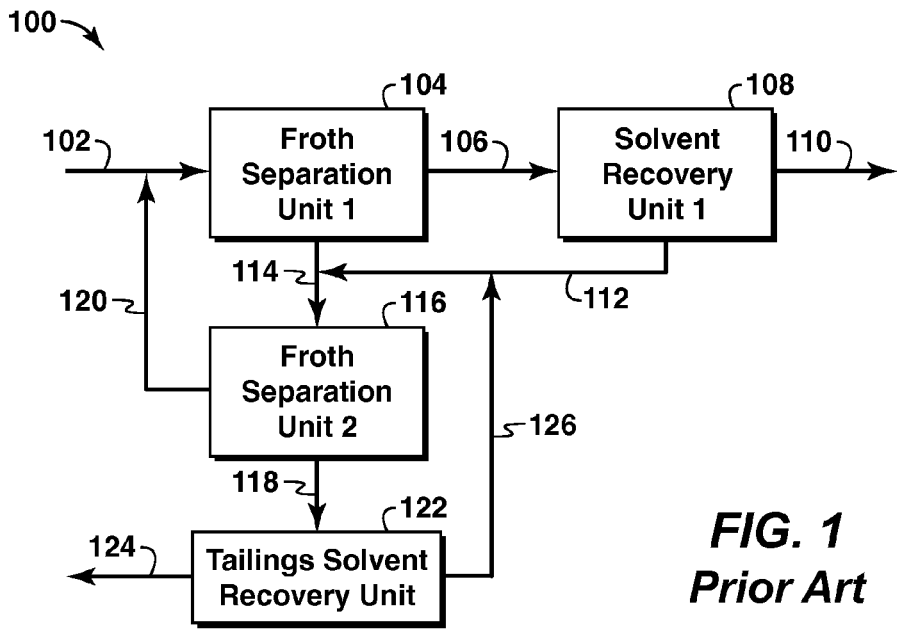
FIG. 1 Prior Art
FIG. 1 is a schematic of an exemplary prior art bitumen froth treatment plant layout.

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

The term "asphaltenes" as used herein refers to hydrocarbons, which are the n-heptane insoluble, toluene soluble component of a carbonaceous material such as crude oil, bitumen or coal. Generally, asphaltenes have a density of from about 0.8 grams per cubic centimeter (g/cc) to about 1.2 g/cc. Asphaltenes are primarily comprised of carbon, hydrogen, nitrogen, oxygen, and sulfur as well as trace vanadium and nickel. The carbon to hydrogen ratio is approximately 1:1.2, depending on the source.

The term "mineral solids" as used herein refers to "clumps" of non-volatile, non-hydrocarbon solid minerals. Depending on the deposit, these mineral solids may have a density of from about 2.0 g/cc to about 3.0 g/cc and may comprise silicon, aluminum (e.g. silicas and clays), iron, sulfur, and titanium and range in size from less than 1 micron (μm) to about 1,000 microns (in diameter).

The term "fine solids" as used herein refers to either or both of asphaltenes and mineral solids, but does not generally refer to sand and clumps of clay, rock and other solids larger than about one hundred (100) microns.

The term "aggregates" as used herein generally refers to a group of solids comprising "asphaltenes" and "mineral solids".

The term "bitumen" as used herein refers to heavy oil having an API gravity of about 12° or lower. In its natural state as oil sands, bitumen generally includes fine solids such as mineral solids and asphaltenes, but as used herein, bitumen may refer to the natural state or a processed state in which the fine solids have been removed and the bitumen has been treated to a higher API gravity.

The term "paraffinic solvent" (also known as aliphatic) as used herein means solvents containing normal paraffins, iso-paraffins and blends thereof in amounts greater than 50 weight percent (wt %). Presence of other components such as olefins, aromatics or naphthenes counteract the function of the paraffinic solvent and hence should not be present more than 1 to 20 wt % combined and preferably, no more than 3 wt % is present. The paraffinic solvent may be a C4 to C20 paraffinic hydrocarbon solvent or any combination of iso and normal components thereof. In one embodiment, the paraffinic solvent comprises pentane, iso-pentane, or a combination thereof. In one embodiment, the paraffinic solvent comprises about 60 wt % pentane and about 40 wt % iso-pentane, with none or less than 20 wt % of the counteracting components referred above.

The invention relates to processes and systems for recovering hydrocarbons. In one aspect, the invention is a process to partially upgrade a bitumen or heavy crude and is particularly suited for bitumen froth generated from oil sands which contain bitumen, water, asphaltenes and mineral solids. The process includes extracting bitumen having asphaltenes and mineral solids from a reservoir in the form of a bitumen froth, adding a solvent to the bitumen-froth, then adding water droplets to the solvent bitumen-froth mixture to enhance the settling rate of asphaltenes and mineral solids from the bitumen-froth.

In another aspect, the invention relates to a system for recovering hydrocarbons. The system may be a plant located at or near a bitumen (e.g. heavy hydrocarbon) mining or recovery site or zone. The plant may include at least one froth separation unit (FSU) having a bitumen froth inlet for receiving bitumen froth (or a solvent froth-treated bitumen mixture) and a diluted bitumen outlet for sending diluted bitumen from the FSU. The plant further includes a water droplet production unit configured to add water droplets to the solvent froth-treated bitumen mixture, one or more of the FSU's and/or the diluted bitumen from at least one of the FSU's. The plant may also include at least one tailings solvent recovery unit (TSRU), solvent storage unit, pumps, compressors, and other equipment for treating and handling the heavy hydrocarbons and byproducts of the recovery system.

Referring now to the figures, FIG. 1 is a schematic of an exemplary prior art paraffinic froth treatment system. The plant 100 receives bitumen froth 102 from a heavy hydrocarbon recovery process (e.g., CHWE). The bitumen froth 102 is fed into a first froth separation unit (FSU) 104 and solvent-rich oil 120 is mixed with the bitumen froth 102. A diluted bitumen stream 106 and a tailings stream 114 are produced from the FSU 104. The diluted bitumen stream 106 is sent to a solvent recovery unit (SRU) 108, which separates bitumen from solvent to produce a bitumen stream 110 that meets pipeline specifications. The SRU 108 also produces a solvent stream 112, which is mixed with tailings 114 from the first FSU 104 and fed into a second froth separation unit 116. The second FSU 116 produces a solvent rich oil stream 120 and a tailings stream 118. The solvent rich oil stream 120 is mixed with the incoming bitumen froth 102 and the tailings stream is sent to a tailings solvent (TSRU) recovery unit 122, which produces a tailings stream 124 and a solvent stream 126.

In an exemplary embodiment of the process the bitumen froth 102 may be mixed with a solvent-rich oil stream 120 from FSU 116 in FSU 104. The temperature of FSU 104 may be maintained at about 60 to 80 degrees Celsius (° C.), or about 70° C. and the target solvent to bitumen ratio is about 1.4:1 to 2.2:1 by weight or about 1.6:1 by weight. The overflow from FSU 104 is the diluted bitumen product 106 and the bottom stream 114 from FSU 104 is the tailings substantially comprising water, mineral solids, asphaltenes, and some residual bitumen. The residual bitumen from this bottom stream is further extracted in FSU 116 by contacting it with fresh solvent (from e.g. 112 or 126), for example in a 25:1 to 30:1 by weight solvent to bitumen ratio at, for instance, 80 to 100° C., or about 90° C. The solvent-rich overflow 120 from FSU 116 is mixed with the bitumen froth feed 102. The bottom stream 118 from FSU 116 is the tailings substantially comprising solids, water, asphaltenes, and residual solvent. The bottom stream 118 is fed into a tailings solvent recovery unit (TSRU) 122, a series of TSRUs or by another recovery method. In the TSRU 122, residual solvent is recovered and recycled in stream 126 prior to the disposal of the tailings in the tailings ponds (not shown) via a tailings flow line 124. Exemplary operating pressures of FSU 104 and FSU 116 are respectively 550 thousand Pascals gauge (kPag) and 600 kPag. FSUs 104 and 116 are typically made of carbon-steel but may be made of other materials.

Figure 2:
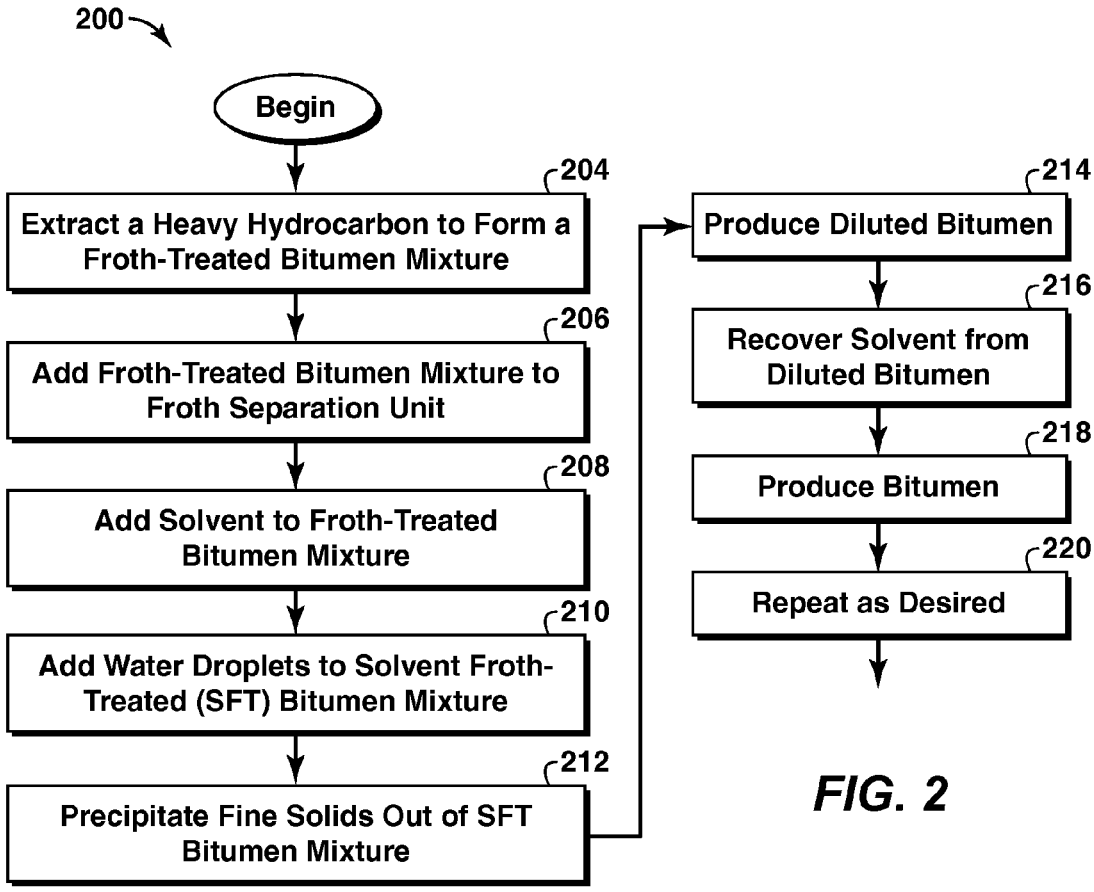
FIG. 2 is a flow chart of an exemplary bitumen froth treatment process including at least one aspect of the present invention.

FIG. 2 is an exemplary flow chart of a process for recovering hydrocarbons utilizing at least a portion of the equipment disclosed in FIG. 1. As such, FIG. 2 may be best understood with reference to FIG. 1. The process 200 begins at block 202, then includes extraction of a heavy hydrocarbon to form a bitumen froth emulsion or mixture 204. After extraction, the mixture is added to a froth separation unit (FSU) 206, solvent is added to the mixture 208, and water droplets are added to the solvent bitumen-froth mixture 210. Steps 206, 208, and 210 may be done concurrently or in sequence in any order. This will promote precipitation and settling of asphaltenes and mineral solids (and aggregates thereof) out of the solvent bitumen-froth mixture 212 to produce a diluted bitumen 214. Solvent is then recovered from the diluted bitumen 216 to produce bitumen 218. The process 200 may be repeated as necessary or desired 220.

Still referring to FIGS. 1 and 2, the step of extracting the heavy hydrocarbon (e.g. bitumen) 204 may include using a froth treatment resulting in a bitumen-froth mixture. An exemplary composition of the resulting bitumen froth 102 is about 60 wt % bitumen, 30 wt % water and 10 wt % solids, with some variations to account for the extraction processing conditions. In such an extraction process oil sands are mined, bitumen is extracted from the sands using water (e.g. the CHWE process or a cold water extraction process), and the bitumen is separated as a froth comprising bitumen, water, solids and air. In the extraction step 204 air is added to the bitumen/water/sand slurry to help separate bitumen from sand, clay and other mineral matter. The bitumen attaches to the air bubbles and rises to the top of the separator (not shown) to form a bitumen-rich froth 102 while the sand and other large particles settle to the bottom. Regardless of the type of water based oil sand extraction process employed, the extraction process 204 will typically result in the production of a bitumen froth product stream 102 comprising bitumen, water and fine solids (including asphaltenes, mineral solids) and a tailings stream 114 consisting essentially of water and mineral solids and some fine solids.

In one embodiment of the process 200 solvent 120 is added to the bitumen-froth 102 after extraction and the mixture is pumped to another separation vessel (froth separation unit or FSU 104). The addition of solvent 120 helps remove the remaining fine solids and water. Put another way, solvent addition increases the settling rate of the fine solids and water out of the bitumen mixture. In one embodiment of the recovery process 200 a paraffinic solvent is used to dilute the bitumen froth 102 before separating the product bitumen by gravity in a device such as FSU 104. Where a paraffinic solvent is used (e.g. when the weight ratio of solvent to bitumen is greater than 0.8), a portion of the asphaltenes in the bitumen are rejected thus achieving solid and water levels that are lower than those in existing naphtha-based froth treatment (NFT) processes. In the NFT process, naphtha may also be used to dilute the bitumen froth 102 before separating the diluted bitumen by centrifugation (not shown), but not meeting pipeline quality specifications.

Adding water droplets 210 to the bitumen froth mixture 102 helps increase the settling rate of the fine solids including asphaltenes, making the process 200 more efficient and allowing higher throughputs of bitumen to be treated and recovered or permitting smaller FSU's 104 and 116 to be used. This result is counterintuitive because it calls for adding water to the bitumen froth solvent mixture 102 even though bitumen froth already contains large quantities of water (e.g., 30-40% or more depending on the extraction process). Note, the process calls for adding "droplets," which may vary in size, but as used in this application, a droplet is generally a volume of water small enough to maintain droplet form when falling through air and does not included water "slugs."

The water droplets may be added before mixing the froth treated bitumen with solvent, may be added in the first FSU 104 and/or the second FSU 116 (note, some plants 100 may include three or more FSU's, any of which may include water droplet addition, depending on the plant 100 and process 200 parameters). The water may also be added above or below a feed injection point in the first or second FSU 104, 116. The water droplet addition increases the propensity of the mineral solids and asphaltenes to attach to each other to create larger particles. The larger particles then settle faster than smaller particles resulting in an increase in the settling rate of greater than a factor of two. The amount of water added can be optimized to enhance the settling rate of the minerals and asphaltenes. Higher settling rates may also permit reduction of the size and cost of the FSU vessels 104, 116 required to meet the pipeline sediment specification. For example, the vessels 104, 116 may have an eight to twelve meter diameter rather than an 18 to 22 meter diameter. The addition of water can also be used to optimize an existing paraffinic froth-treatment by increasing the production rate and/or improving the product quality.

As would be expected with any process, the optimum conditions would be preferred to produce the largest particle size distribution and subsequently the fastest settling time. Variables may be optimized include, but are not limited to; water-to-bitumen ratio (e.g. from 0.01 weight percent (wt %) to 10 wt %), mixing energy, water droplet size, temperature, solvent addition, and location of water addition. Water may be added either to the FSU feed streams 102, 114 and/or internally within the FSU vessels 104, 116. Within the FSU vessels the water can be added either above and/or below the feed injection point. Further, the type of water used will depend on the available water sources, but is preferably one of fresh river water, distilled water from a solvent recovery unit 108, recycled water, rain water, or aquifer water.

Figure 3:
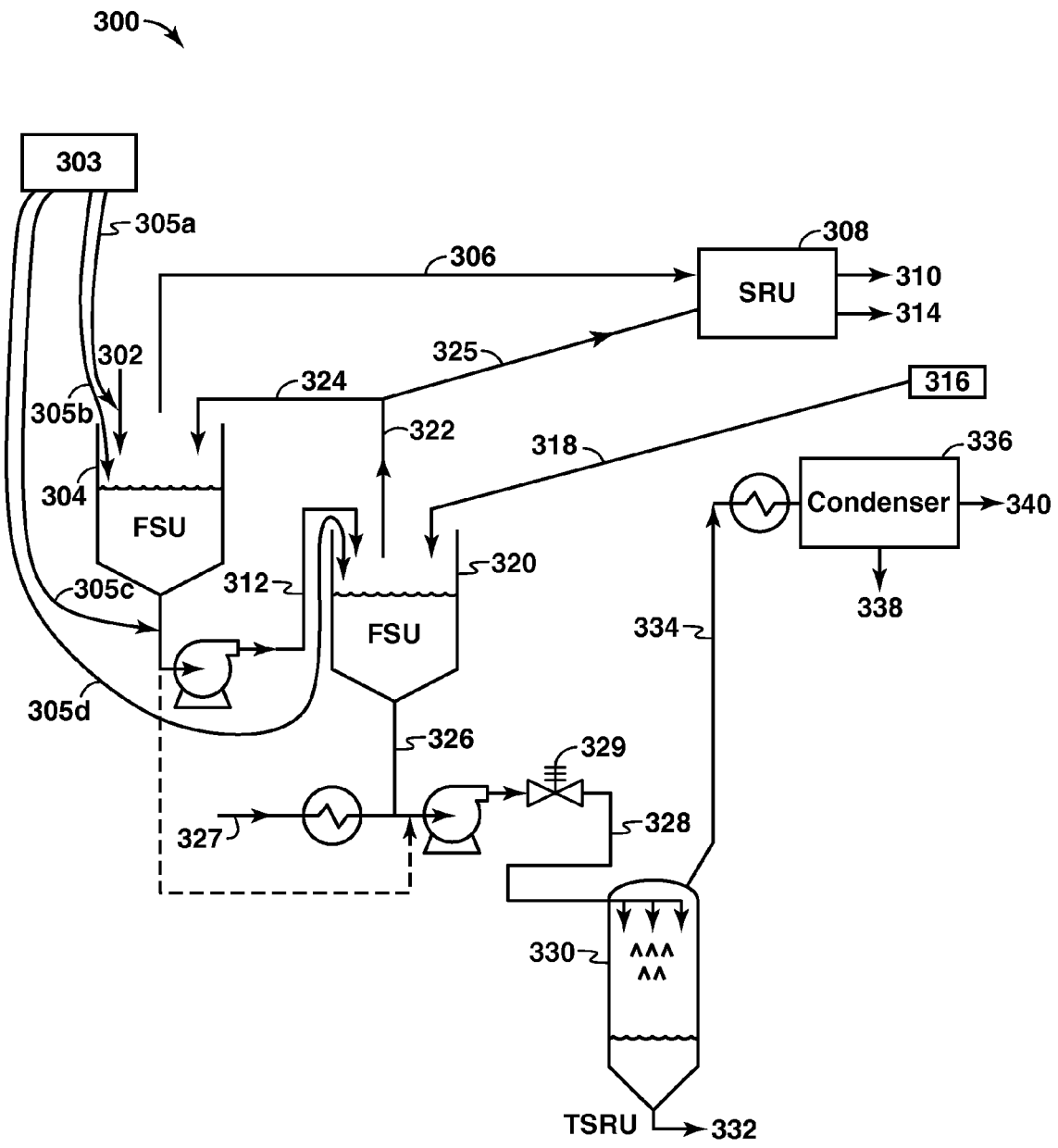
FIG. 3 is a schematic of an exemplary bitumen froth treatment plant layout including at least one aspect of the present invention.

FIG. 3 is an exemplary schematic of a bitumen froth treatment plant layout utilizing the process of FIG. 2. As such, FIG. 3 may be best understood with reference to FIG. 2. The plant 300 includes a bitumen froth input stream 302 input to a froth separation unit (FSU) 304, which separates stream 302 into a diluted bitumen component 306 comprising bitumen and solvent and a froth treatment tailings component 312 substantially comprising water, mineral solids, precipitated asphaltenes (and aggregates thereof), solvent, and small amounts of unrecovered bitumen. The tailings stream 312 may be withdrawn from the bottom of FSU 304, which may have a conical shape at the bottom. A water droplet production unit 303 is also included, which produces water droplets 305*a*, 305*b*, 305*c* and/or 305*d* for addition to, respectively, the bitumen froth input stream 302, FSU 304, tailings stream 312, or FSU 320.

In one embodiment, the water droplet production unit 303 may be a spray nozzle system. The unit 303 may produce droplets at a concentration of at least about 0.01 weight percent (wt %) relative to bitumen to at most about 10 wt % relative to bitumen depending on the composition of the bitumen, size of the handling units (e.g. FSU's) and other factors. Further, the droplets may be produced at a size of from at least about 5 microns (μm) in diameter to about 1,000 microns in diameter, although a range of from about 5 microns to about 500 microns is preferred. The added water may be fresh river water, distilled water from a solvent recovery unit 308, recycled water, rain water or aquifer water.

The diluted bitumen component 306 is passed through a solvent recovery unit, SRU 308, such as a conventional fractionation vessel or other suitable apparatus in which the solvent 314 is flashed off and condensed in a condenser 316 associated with the solvent flashing apparatus and recycled/reused in the process 300. The solvent free bitumen product 310 is then stored or transported for further processing in a manner well known in the art. Froth treatment tailings component 312 may be passed directly to the tailings solvent recovery unit (TSRU) 330 or may first be passed to a second FSU 320.

In one embodiment, FSU 304 operates at a temperature of about 60° C. to about 80° C., or about 70° C. In one embodiment, FSU 304 operates at a pressure of about 700 to about 900 kPa, or about 800 kPa. Diluted tailings component 312 may typically comprise approximately 50 to 70 wt % water, 15 to 25 wt % mineral solids, and 5 to 25 wt % hydrocarbons. The hydrocarbons comprise asphaltenes (for example 2.0 to 12 wt % or 9 wt % of the tailings), bitumen (for example about 7.0 wt % of the tailings), and solvent (for example about 8.0 wt % of the tailings). In additional embodiments, the tailings comprise greater than 1.0, greater than 2.0, greater than 3.0, greater than 4.0, greater than 5.0, greater than 10.0 wt % asphaltenes, or about 15.0 wt % asphaltenes.

Still referring to FIG. 3, FSU 320 performs generally the same function as FSU 304, but is fed the tailings component 312 rather than a bitumen froth feed 302. The operating temperature of FSU 320 may be higher than that of FSU 304 and may be between about 80° C. and about 100° C., or about 90° C. In one embodiment, FSU 320 operates at a pressure of about 700 to about 900 kPa, or about 800 kPa. A diluted bitumen component stream 322 comprising bitumen and solvent is removed from FSU 320 and is either sent to FSU 304 via feed 324 for use as solvent to induce asphaltene separation or is passed to SRU 308 via feed 325 or to an another SRU (not shown) for treatment in the same way as the diluted bitumen component 306. The ratio of solvent:bitumen in diluted bitumen component 322 may be, for instance, 1.4 to 30:1, or about 20:1. Alternatively, diluted bitumen component 322 may be partially passed to FSU 304 via line 324 and partially passed to SRU 308 via line 325, or to another SRU (not shown). Solvent 314 from SRU 308 may be combined with the diluted tailing stream 312 into FSU 320, shown as stream 318, or returned to a solvent storage tank (not shown) from where it is recycled to make the diluted bitumen froth stream 302. Thus, streams 322 and 318 show recycling. In the art, solvent or diluted froth recycling steps are known such as described in U.S. Pat. No. 5,236,577.

In the exemplary system of FIG. 3, the froth treatment tailings 312 or tailings component 326 (with a composition similar to underflow stream 312 but having less bitumen and solvent), may be combined with dilution water 327 to form diluted tailings component 328 and is sent to TSRU 330. Diluted tailings component 328 may be pumped from the FSU 320 or FSU 304 (for a single stage FSU configuration) to TSRU 330 at the same temperature and pressure in FSU 320 or FSU 304. A backpressure control valve 329 may be used before an inlet into TSRU 330 to prevent solvent flashing prematurely in the transfer line between FSU 320 and TSRU 330.

Flashed solvent vapor and steam (together 334) is sent from TSRU 330 to a condenser 336 for condensing both water 338 and solvent 340. Recovered solvent 340 may be reused in the bitumen froth treatment plant 300. Tailings component 332 may be sent directly from TSRU 330 to a tailings storage area (not shown) for future reclamation or sent to a second TSRU (not shown) or other devices for further treatment. Tailings component 332 contains mainly water, asphaltenes, mineral matter, and small amounts of solvent as well as unrecovered bitumen. A third TSRU (not shown) could also be used in series and, in each subsequent stage, the operating pressure may be lower than the previous one to achieve additional solvent recovery. In fact, more than three TSRU's could be used, depending on the quality of bitumen, pipeline specification, size of the units and other operating factors.

EXAMPLES

Experiments were conducted to test the effectiveness of water droplet addition to the bitumen froth streams. The experiments were designed to take small samples of bitumen froth streams, add some water droplets in accordance with the present invention and capture images of the bitumen froth streams before and after addition of the water droplets.

Figure 4:
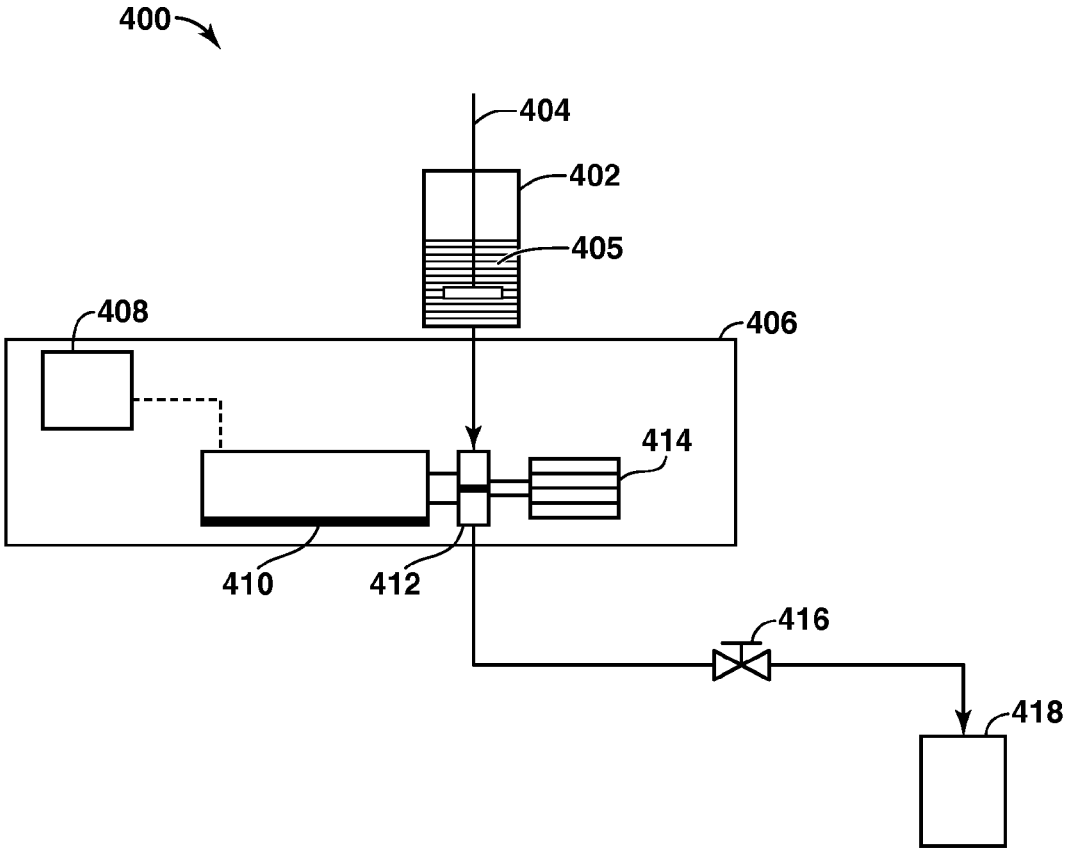
FIG. 4 is a schematic illustration of the experimental apparatus utilized with the present invention as disclosed in FIGS. 2 and 3.

FIG. 4 is a schematic illustration of the experimental apparatus utilized with the present invention as disclosed in FIGS. 2 and 3. Hence, FIG. 4 may be best understood with reference to FIGS. 2 and 3. The experimental setup 400 includes a vessel 402 with a stirrer 404 holding a sample of bitumen froth 405. The vessel is connected to a particle size analyzer apparatus 406, which includes a particle sizing computer system 408, an image analyzer 410, a variable width flow cell 412, and a light source 414. The particle size analyzer apparatus 406 is then connected to a pinch clamp 416 and a beaker 418 for receiving the analyzed samples 405.

Example 1

In the first example, the bitumen froth sample 405 was 75 grams of Syncrude bitumen froth (60 wt % bitumen, 30 wt % water and 10 wt % mineral matter). The bitumen froth 405 was added to 400 ml of 60/40 pentane/iso-pentane solvent and stirred with the stirrer 404 in the vessel 402. This particular bitumen froth 405 was chosen because its composition is representative of produced bitumen froth 102 or 302. The stirrer 404 was used to mix the contents and keep the solids suspended in solution. The bitumen solvent mixture 405 was fed by gravity to the particle size analyzer apparatus 406. In this case, a JM Canty Microflow Particle Size system (Model #MIC-LG2K11B11GZ) was used. The sample 405 was fed to the flow cell 412 at approximately 150 ml/min. The gap in the flow cell 412 was set at an optimum width of 300 micrometers (μm). Too large a gap did not provide enough light to resolve the particles while too small a gap restricted the flow of the particles. Images were taken by the image analyzer 410 and recorded by the computer system 408.

Figure 5:
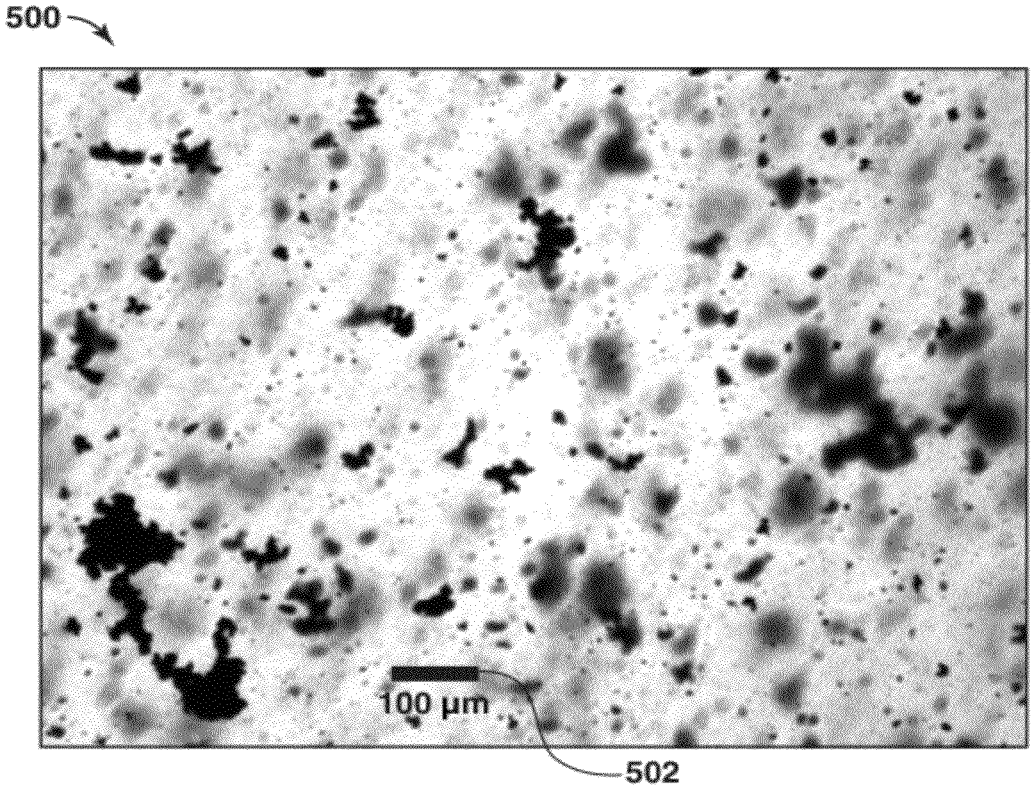
FIG. 5 is an image of asphaltene-mineral aggregates obtained with a JM Canty Microflow Particle Sizing System.

FIG. 5 is an image of asphaltene-mineral aggregates obtained with the particle size analyzer apparatus 406 with no water addition to the bitumen-froth-solvent mixture 405. The scale of the image 500 is shown on the image by a 100 micro-meter (micron or μm) line 502. As can be seen, numerous particles less than 100 μm in size are observed.

Example 2

In a second test, the bitumen froth sample 405 was 75 grams of Syncrude bitumen froth (60 wt % bitumen, 30 wt % water and 10 wt % mineral matter). The bitumen froth 405 was added to 400 ml of 60/40 pentane/iso-pentane solvent and stirred with the stirrer 404 in the vessel 402. The stirrer 404 was used to mix the contents and keep the solids suspended in solution for a few minutes. Then, about 50 grams of water was added to the bitumen froth-solvent mixture 405 while the stirrer 404 continued to mix the solution. The bitumen-solvent-water mixture was fed by gravity to the flow cell 412 at approximately 150 ml/min. The gap in the flow cell was set at an optimum width of 300 μm. Images were taken by the image analyzer 410 and recorded by the computer system 408.

Figure 6A:
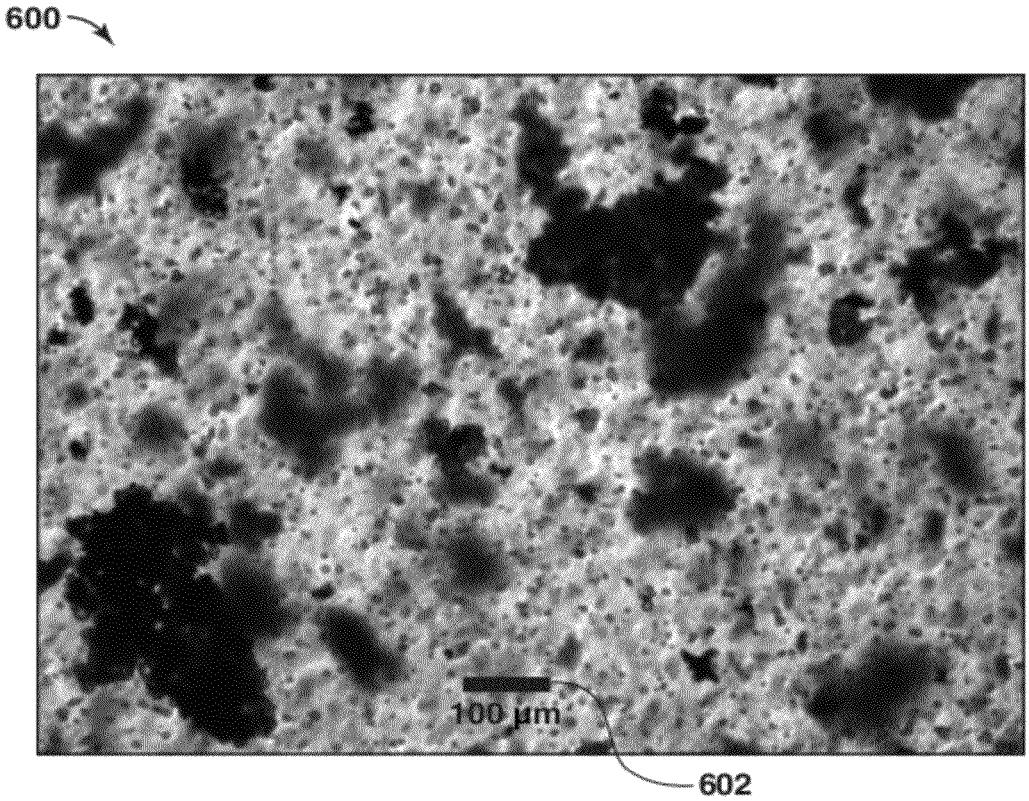
FIGS. 6A-6B are images of asphaltene-mineral-water aggregates obtained after the addition of water to the bitumen-froth-solvent mixture.
Figure 6B:
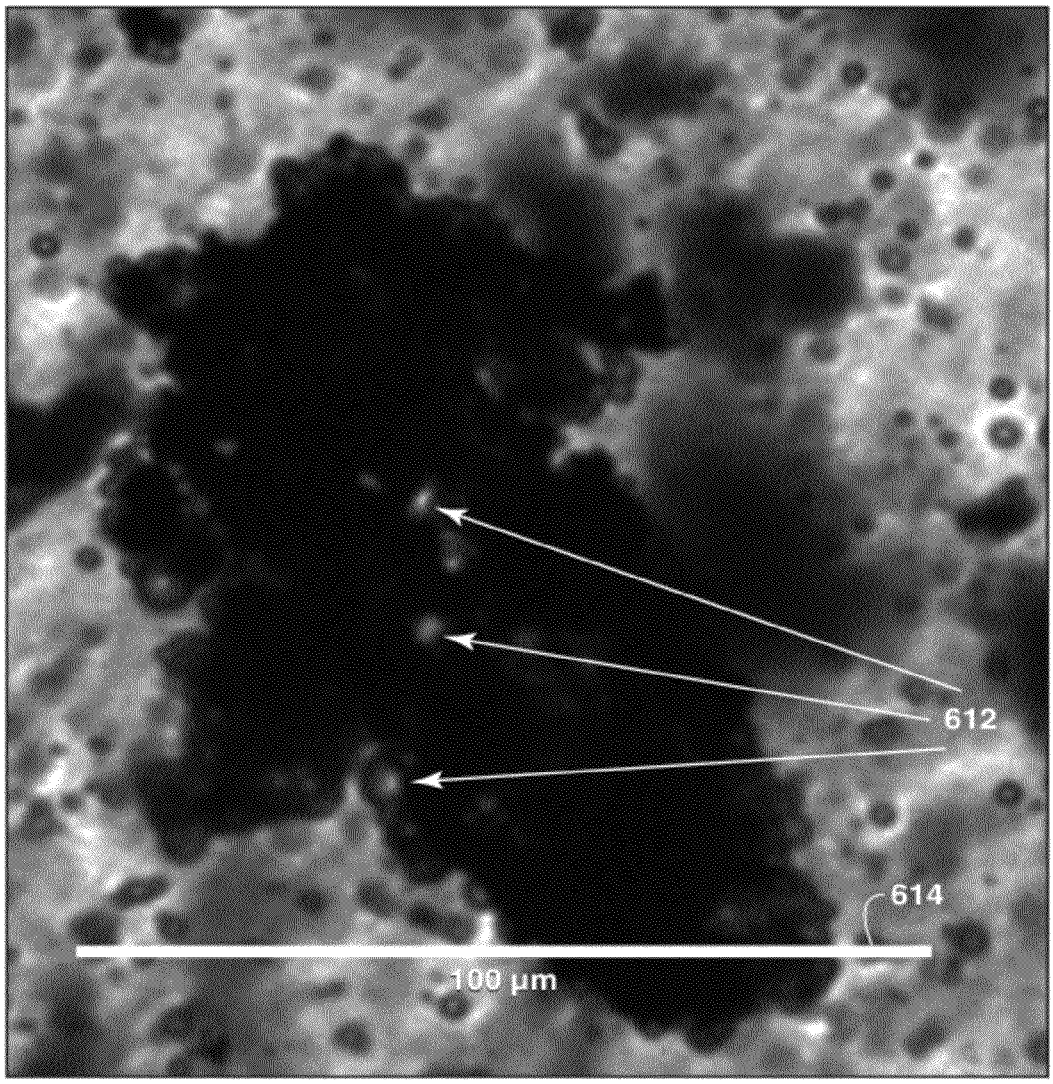

FIGS. 6A-6B are images of asphaltene-mineral-water aggregates obtained after the addition of water to the bitumen-froth-solvent mixture 405. In FIG. 6A, the scale of the image 600 is shown by a 100 micron line 602. As shown, particles significantly greater than 100 microns are generated. In comparison to the image 500, there appear to be more large particles. FIG. 6B shows a magnified image 610 of the particulates bounded with water droplets 612. The image 610 is magnified to show more clearly the presence and location of water droplets 612. The scale of the image 610 is shown by a 100 micron line 614.

While the present invention may be susceptible to various modifications and alternative forms, the exemplary embodiments discussed above have been shown only by way of example. However, it should again be understood that the invention is not intended to be limited to the particular embodiments disclosed herein. Indeed, the present invention includes all alternatives, modifications, and equivalents falling within the true spirit and scope of the appended claims.

What is claimed is:

1. A method of recovering hydrocarbons, comprising:

providing a bitumen-froth emulsion containing asphaltenes and mineral solids;

adding a solvent to the bitumen-froth emulsion to induce a rate of settling of at least a portion of the asphaltenes and mineral solids from the bitumen-froth emulsion and generate a solvent bitumen-froth mixture; and adding water droplets by a spray nozzle system to the solvent bitumen-froth mixture to increase the rate of settling of the at least a portion of the asphaltenes and mineral solids, wherein the water droplets are added in a concentration of from about 0.01 weight percent (wt %) relative to bitumen to about 10 wt % relative to bitumen, and wherein the addition of the water droplets increases the size of the asphaltenes from about 10 microns to at least about 1,000 microns.

2. The method of claim 1, wherein the solvent is a paraffinic solvent to form a paraffinic froth-treated (PFT) bitumen stream.

3. The method of claim 1, further comprising processing the solvent bitumen-froth mixture in at least a first separation vessel to form a processed solvent bitumen-froth mixture and a separation tailings stream.

4. The method of claim 3, further comprising processing the separation tailings stream in at least a second separation vessel.

5. The method of claim 3, wherein the water droplets are added to the solvent bitumen-froth mixture before the solvent bitumen-froth mixture is processed in the first separation vessel.

6. The method of claim 3, further comprising adding the water droplets to the separation tailings stream before the separation tailings stream is added to the second separation vessel.

7. The method of claim 3, wherein the water droplets are added in the first separation vessel.

8. The method of claim 7, wherein the water is added above or below a feed injection point in the first or separation vessel.

9. The method of claim 1, wherein the water droplets are one of fresh river water, distilled water from a solvent recovery unit, recycled water, rain water, or aquifer water.

10. The method of claim 1, wherein the addition of the water droplets increases the rate of settling by a factor of greater than two.

11. The method of claim 1 further comprising: optimizing a variable selected from the group consisting of: water-to-bitumen ratio, water droplet size, temperature, solvent addition rate, location of water addition, mixing energy, and any combination thereof.

12. A method of recovering hydrocarbons, comprising:

providing a bitumen-froth emulsion containing asphaltenes and mineral solids;

adding a solvent to the bitumen-froth emulsion to induce a rate of settling of at least a portion of the asphaltenes and mineral solids from the bitumen-froth emulsion and generate a solvent bitumen-froth mixture;

producing water droplets at a size of at least about 1 micron to about 1,000 microns; and adding the water droplets by a spray nozzle system to the solvent bitumen-froth mixture to increase the rate of settling of the at least a portion of the asphaltenes and mineral solids, wherein the water droplets are added in a concentration of from about 0.01 weight percent (wt %) relative to bitumen to about 10 wt % relative to bitumen, and wherein the addition of the water droplets increases the size of the asphaltenes from about 10 microns to at least about 1,000 microns.

13. The method of claim 12, further comprising processing the solvent bitumen-froth mixture in at least a first separation vessel to form a processed solvent bitumen-froth mixture and a separation tailings stream.

14. The method of claim 13, wherein the water droplets are added to the solvent bitumen-froth mixture before the solvent bitumen-froth mixture is processed in the first separation vessel.

15. The method of claim 13, wherein the water droplets are added in one of the first separation vessel.

16. The method of claim 12, wherein the addition of the water droplets increases the rate of settling by a factor of greater than two.

17. The method of claim 12, further comprising optimizing the water droplet size.

18. The method of claim 3, further comprising adding the water droplets in the second separation vessel.

19. The method of claim 18, wherein the additional water droplets are added above or below a feed injection point in the second separation vessel.

* * * * *